US006495056B2

(12) United States Patent
Kubo et al.

(10) Patent No.: US 6,495,056 B2
(45) Date of Patent: Dec. 17, 2002

(54) PROTEIN FOAM FIRE-EXTINGUISHING CHEMICAL AND AN AQUEOUS FOAM SOLUTION

(75) Inventors: Daizo Kubo, Osaka-fu (JP); Yasuyoshi Fukuda, Osaka-fu (JP)

(73) Assignee: Yamato Protec Corporation, Osaka (JP)

( * ) Notice: Subject to any disclaimer, the term of this patent is extended or adjusted under 35 U.S.C. 154(b) by 0 days.

(21) Appl. No.: 09/874,989

(22) Filed: Jun. 7, 2001

(65) Prior Publication Data

US 2002/0043641 A1 Apr. 18, 2002

(30) Foreign Application Priority Data

Oct. 12, 2000 (JP) ..... 2000-311954

(51) Int. Cl.[7] ..... A62D 1/04; A62D 1/02; A62D 1/00

(52) U.S. Cl. ..... 252/8.05; 252/2; 252/3

(58) Field of Search ..... 252/3, 2, 8.05

(56) References Cited

U.S. PATENT DOCUMENTS 2,324,951 A * 6/1943 Ratzer
2,697,691 A * 12/1954 Perri ..... 252/8.05
3,475,333 A * 10/1969 Meldrum ..... 252/3
3,562,156 A * 2/1971 Francen ..... 252/8.05
4,090,967 A * 5/1978 Falk ..... 252/3
4,149,599 A * 4/1979 Chiesa, Jr. ..... 169/47
4,439,329 A * 3/1984 Kleiner et al. ..... 252/8.05
4,770,794 A * 9/1988 Cundasawmy et al. ..... 252/3
5,091,097 A * 2/1992 Pennartz ..... 252/7
5,225,095 A * 7/1993 DiMaio et al. ..... 252/3
5,616,273 A * 4/1997 Clark et al. ..... 252/2

FOREIGN PATENT DOCUMENTS

JP 52-154298 A 12/1977
JP 56-060577 A 5/1981

* cited by examiner

*Primary Examiner*—Joseph D. Anthony
(74) *Attorney, Agent, or Firm*—Griffin & Szipl, P.C.

(57) ABSTRACT

According to the present invention, there can be provided a protein foam fire-extinguishing chemical having foaming properties making it usable as a foam fire-extinguishing chemical even diluted at a concentration of 2% by volume or less. In the protein foam fire-extinguishing chemical according to the present invention, the protein hydrolyzates are contained in an amount of 25 to 40% by weight in terms of the solid content thereof, and one or more members selected from the group consisting of 2-methyl-2,4-pentanediol, 3-methyl-3-methoxy butanol, diethylene glycol monobutyl ether and diethylene glycol monoisopropyl ether are contained as the foaming assistant in an amount of 8 to 20% by weight.

14 Claims, 4 Drawing Sheets

* COMPOUNDING RATIO IS IN % BY WEIGHT.

| | EMBODIMENT 1 | EMBODIMENT 2 | EMBODIMENT 3 | EMBODIMENT 4 | EMBODIMENT 5 | COMPARATIVE EXAMPLE 1 |
|---|---|---|---|---|---|---|
| PROTEIN HYDROLYZATES (SOLID CONTENT) | 32.0 | 32.0 | 32.0 | 32.0 | 36.0 | 32.0 |
| IRON SULFATE | 1.0 | 1.0 | 1.0 | 1.0 | 1.0 | 1.0 |
| 3-METHYL-3-METHOXYBUTANOL | 15.0 | 0.0 | 0.0 | 0.0 | 0.0 | 0.0 |
| 2-METHYL-2,4-PENTANEDIOL | 0.0 | 15.0 | 5.0 | 0.0 | 5.0 | 3.0 |
| DIETHYLENE GLYCOL MONOBUTYL ETHER | 0.0 | 0.0 | 10.0 | 0.0 | 10.0 | 0.0 |
| DIETHYLENE GLYCOL MONOISOPROPYL ETHER | 0.0 | 0.0 | 0.0 | 15.0 | 0.0 | 0.0 |
| ETHYLENE GLYCOL | 0.0 | 0.0 | 0.0 | 0.0 | 0.0 | 5.0 |
| WATER | 52.0 | 52.0 | 52.0 | 52.0 | 48.0 | 59.0 |
| | | | | | | |
| PRODUCT VISCOSITY (cSt:20° C) | 36 | 40 | 39 | 41 | 45 | 25 |

| | | | | | | | |
|---|---|---|---|---|---|---|---|
| 2% DILUTION | DEGREE OF FOAMING (TIMES) | 8 TIMES OR MORE | 8 TIMES OR MORE | 8 TIMES OR MORE | 8 TIMES OR MORE | 8 TIMES OR MORE | 4.3 TIMES |
| | 25% REDUCTION TIME (SEC.) | 3 MINUTES OR MORE | 3 MINUTES OR MORE | 3 MINUTES OR MORE | 3 MINUTES OR MORE | 3 MINUTES OR MORE | 1 MINUTE OR LESS |
| | FIRE-EXTIN-GUISHING PERFORM-ANCE | GOOD | GOOD | GOOD | GOOD | GOOD | INFEASIBLE FIRE EXTINCTION |
| | SEALING PROPERTIES | GOOD | GOOD | GOOD | GOOD | GOOD | NOT CONDUCTED |
| | FIRE RESISTANCE | GOOD | GOOD | GOOD | GOOD | GOOD | NOT CONDUCTED |
| PRACTICAL USABILITY UPON MIXED WITH WATER | | ○ | ○ | ○ | ○ | ○ | ○ |

* COMPOUNDING RATIO IS IN % BY WEIGHT.

| | EMBODIMENT 1 | EMBODIMENT 2 | EMBODIMENT 3 | EMBODIMENT 4 | EMBODIMENT 5 | COMPARATIVE EXAMPLE 1 |
|---|---|---|---|---|---|---|
| PROTEIN HYDROLYZATES (SOLID CONTENT) | 32.0 | 32.0 | 32.0 | 32.0 | 36.0 | 32.0 |
| IRON SULFATE | 1.0 | 1.0 | 1.0 | 1.0 | 1.0 | 1.0 |
| 3-METHYL-3-METHOXYBUTANOL | 15.0 | 0.0 | 0.0 | 0.0 | 0.0 | 0.0 |
| 2-METHYL-2,4-PENTANEDIOL | 0.0 | 15.0 | 5.0 | 0.0 | 5.0 | 3.0 |
| DIETHYLENE GLYCOL MONOBUTYL ETHER | 0.0 | 0.0 | 10.0 | 0.0 | 10.0 | 0.0 |
| DIETHYLENE GLYCOL MONOISOPROPYL ETHER | 0.0 | 0.0 | 0.0 | 15.0 | 0.0 | 0.0 |
| ETHYLENE GLYCOL | 0.0 | 0.0 | 0.0 | 0.0 | 0.0 | 5.0 |
| WATER | 52.0 | 52.0 | 52.0 | 52.0 | 48.0 | 59.0 |
| | | | | | | |
| PRODUCT VISCOSITY (cSt:20° C) | 36 | 40 | 39 | 41 | 45 | 25 |

FIG.1A

| | | | | | | | |
|---|---|---|---|---|---|---|---|
| 2% DILUTION | DEGREE OF FOAMING (TIMES) | 8 TIMES OR MORE | 8 TIMES OR MORE | 8 TIMES OR MORE | 8 TIMES OR MORE | 8 TIMES OR MORE | 4.3 TIMES |
| | 25% REDUCTION TIME (SEC.) | 3 MINUTES OR MORE | 3 MINUTES OR MORE | 3 MINUTES OR MORE | 3 MINUTES OR MORE | 3 MINUTES OR MORE | 1 MINUTE OR LESS |
| | FIRE-EXTIN-GUISHING PERFORM-ANCE | GOOD | GOOD | GOOD | GOOD | GOOD | INFEASIBLE FIRE EXTINCTION |
| | SEALING PROPERTIES | GOOD | GOOD | GOOD | GOOD | GOOD | NOT CONDUCTED |
| | FIRE RESISTANCE | GOOD | GOOD | GOOD | GOOD | GOOD | NOT CONDUCTED |
| PRACTICAL USABILITY UPON MIXED WITH WATER | | ○ | ○ | ○ | ○ | ○ | ○ |

FIG.1B

* COMPOUNDING RATIO IS IN % BY WEIGHT.

| | COMPARATIVE EXAMPLE 2 | COMPARATIVE EXAMPLE 3 | EMBODIMENT 6 | EMBODIMENT 7 | EMBODIMENT 8 | EMBODIMENT 9 | COMPARATIVE EXAMPLE 4 |
|---|---|---|---|---|---|---|---|
| PROTEIN HYDROLYZATES (SOLID CONTENT) | 32.0 | 32.0 | 32.0 | 32.0 | 32.0 | 32.0 | 32.0 |
| IRON SULFATE | 1.0 | 1.0 | 1.0 | 1.0 | 1.0 | 1.0 | 1.0 |
| 3-METHYL-3-METHOXYBUTANOL | 0.0 | 0.0 | 0.0 | 0.0 | 0.0 | 0.0 | 0.0 |
| 2-METHYL-2,4-PENTANEDIOL | 0.0 | 5.0 | 8.0 | 10.0 | 15.0 | 20.0 | 25.0 |
| DIETHYLENE GLYCOL MONOBUTYL ETHER | 0.0 | 0.0 | 0.0 | 0.0 | 0.0 | 0.0 | 0.0 |
| DIETHYLENE GLYCOL MONOISOPROPYL ETHER | 0.0 | 0.0 | 0.0 | 0.0 | 0.0 | 0.0 | 0.0 |
| ETHYLENE GLYCOL | 5.0 | 5.0 | 5.0 | 5.0 | 5.0 | 5.0 | 5.0 |
| WATER | 62.0 | 57.0 | 54.0 | 52.0 | 47.0 | 42.0 | 37.0 |
| | | | | | | | |
| PRODUCT VISCOSITY (cSt:20° C) | 23 | 28 | 35 | 38 | 45 | 55 | 120 |

FIG.2A

| | | | | | | | | |
|---|---|---|---|---|---|---|---|---|
| 2% DILUTION | DEGREE OF FOAMING (TIMES) | 3.8 TIMES | 4.7 TIMES | 8 TIMES OR MORE | 8 TIMES OR MORE | 8 TIMES OR MORE | 8 TIMES OR MORE | — |
| | 25% REDUCTION TIME (SEC.) | 1 MINUTE OR LESS | 1 MINUTE OR LESS | 3 MINUTES OR MORE | 3 MINUTES OR MORE | 3 MINUTES OR MORE | 3 MINUTES OR MORE | — |
| | FIRE-EXTIN-GUISHING PERFORM-ANCE | INFEASIBLE FIRE EXTINCTION | INFEASIBLE FIRE EXTINCTION | GOOD | GOOD | GOOD | GOOD | — |
| | SEALING PROPERTIES | NOT CONDUCTED | NOT CONDUCTED | GOOD | GOOD | GOOD | GOOD | — |
| | FIRE RESISTANCE | NOT CONDUCTED | NOT CONDUCTED | GOOD | GOOD | GOOD | GOOD | — |
| PRACTICAL USABILITY UPON MIXED WITH WATER | | ○ | ○ | ○ | ○ | ○ | ○ | × |

FIG.2B

PROTEIN FOAM FIRE-EXTINGUISHING CHEMICAL AND AN AQUEOUS FOAM SOLUTION

BACKGROUND OF THE INVENTION

1. Field of the Invention

The present invention relates to a protein foam fire-extinguishing chemical used in fire-extinguishing facilities, as well as an aqueous foam solution. In particular, the present invention relates to a protein foam fire-extinguishing chemical having foaming properties usable as a foam fire-extinguishing chemical diluted even at a low concentration of 2% by volume or less, as well as an aqueous foam solution.

2. Description of the Prior Art

A conventional protein foam fire-extinguishing chemical is in a liquid form comprising a product obtained by hydrolyzing protein (referred to hereinafter as "protein hydrolyzates") as a base material and a foam stabilizer such as iron salts, a pour point depressant such as ethylene glycol, etc. compounded therein. As an aqueous foam solution released to a site of fires, there are 6% aqueous foam solution and 3% aqueous foam solution. The 6% aqueous foam solution is an aqueous foam solution consisting of 6 vol-% protein foam fire-extinguishing chemical mixed with 94 vol-% water or seawater, while the 3% aqueous foam solution is an aqueous foam solution consisting of 3 vol-% protein foam fire-extinguishing chemical mixed with 97 vol-% water or seawater. At present, the 3% aqueous foam solution is mainly used.

Whether the foaming properties of a protein foam fire-extinguishing chemical are good or not is determined depending on whether the bubbling properties and foam stability thereof are good or not. As the concentration of a protein foam fire-extinguishing chemical having bubbling properties is increased, the bubbling properties reaches the maximum (plateau) at a certain concentration, and as the concentration is further increased, the bubbling properties are lowered.

The foam stability of an aqueous solution of protein hydrolyzates containing a foam stabilizer is high, but the bubbling properties thereof are moderate. Accordingly, the bubbling properties have been improved heretofore by increasing the concentration of the aqueous solution of protein hydrolyzates thereby achieving foaming properties (foam stability and bubbling properties) making it as a foam fire-extinguishing chemical. That is, unless the concentration of the diluted aqueous foam solution is 3% by volume or more, foaming properties making it usable as a foam fire-extinguishing chemical have never been achieved heretofore.

However, if the 3% aqueous foam solution is to be used at the present when an object (e.g. petroleum tank) of fire extinction becomes enormous and large-scaled, a large amount of the protein foam fire-extinguishing chemical is necessary for the relationship of the mixing ratio described above. Accordingly, a tank for storing the protein foam fire-extinguishing chemical is large-scaled, and a container for stockpiling thereof is also enlarged. Further, the protein foam fire-extinguishing chemical should be conveyed repeatedly from a base for stockpiling thereof to a site of fires in order to achieve a necessary amount of the protein foam fire-extinguishing chemical.

These problems can be solved by reducing the amount of the protein foam fire-extinguishing chemical while maintaining practical foaming properties thereof. Accordingly, the present inventors attempted to reduce the amount of water incorporated into the conventional protein foam fire-extinguishing chemical in order to reduce the concentration thereof diluted with water or seawater at the time of use. However, the present inventors found that this is not practical because the viscosity of the protein foam fire-extinguishing chemical is significantly increased upon reduction of the amount of water in the protein foam fire-extinguishing chemical, thus making it difficult or even infeasible to proportionally mix the resulting aqueous foam solution uniformly and stably in an existing conventional system of mixing a foam fire-extinguishing chemical (that is, a compression or compression-feeding pressure proportional system, a pump proportional system, a line proportional system etc.), resulting in failure to form a normal aqueous foam solution.

The object of the present invention is to provide a protein foam fire-extinguishing chemical and an aqueous foam solution, which can be proportionally mixed without significantly increasing the viscosity of the protein foam fire-extinguishing chemical in a usual system of mixing a foam fire-extinguishing chemical and has foaming properties making itself usable as a foam fire-extinguishing chemical even diluted at a concentration of 2% by volume or less, thus reducing the size of a storing tank and container therefor as well as reducing the number of times the chemical is conveyed from a base for stockpiling to a site of fires.

SUMMARY OF THE INVENTION

The protein foam fire-extinguishing chemical of the present invention is a protein foam fire-extinguishing chemical in a liquid form comprising protein hydrolyzates as a base material as well as a foam stabilizer and a foaming assistant compounded therein, wherein the amount of the foaming assistant compounded is 8 to 20% by weight.

In this case, one or more members selected from the group consisting of 2-methyl-2,4-pentanediol, 3-methyl-3-methoxy butanol, diethylene glycol monobutyl ether and diethylene glycol monoisopropyl ether are contained as the foaming assistant. Further, it is preferable that the protein hydrolyzates are compounded in an amount of 25 to 40% by weight in terms of the solid content thereof.

The aqueous foam solution of the present invention is characterized in that the concentration of the protein foam fire-extinguishing chemical having the composition described above is made 2% by volume or less by mixing it with water or seawater.

The aqueous solution of protein hydrolyzates containing a foam stabilizer has high foam stability and moderate bubbling properties, and the bubbling properties can also be improved by incorporation of a foaming assistant. As the foaming assistant, one or more members selected from the group consisting of 2-methyl-2,4-pentanediol, 3-methyl-3-methoxy butanol, diethylene glycol monobutyl ether and diethylene glycol monoisopropyl ether are contained.

As a result of incorporation of such a foaming assistant, the protein foam fire-extinguishing chemical can be proportionally mixed uniformly and stably while maintaining excellent foaming properties (foam stability and bubbling properties) without significantly increasing the viscosity thereof in a usual system of mixing a foam fire-extinguishing chemical, and can further demonstrate foaming properties usable as a foam fire-extinguishing chemical in an aqueous foam solution diluted even at a low concentration of 2% by volume or less.

The amount of the foaming assistant compounded is preferably 8 to 20% by weight, more preferably 10 to 15% by weight. Depending on the type of the foaming assistant compounded, the amount of the foaming assistant can be increased or decreased within this range. When the amount of the foaming assistant is higher than said range, the viscosity of the protein foam fire-extinguishing chemical is significantly increased to make uniform, stable and proportional mixing infeasible in a usual system of mixing a foam fire-extinguishing chemical, thus making practical use infeasible, while the amount of the foaming assistant is lower than said range, the protein foam fire-extinguishing chemical upon dilution at a low concentration of 2% by volume or less comes to have a lower degree of foaming with a 25% reduction time of 1 minute or less, thus failing to provide an normal aqueous foam solution usable for extinguishing fires.

The amount of the protein hydrolyzates compounded is preferably 25 to 40% by weight, more preferably 30 to 35% by weight, in terms of the solid content thereof. When the amount of the protein hydrolyzates compounded is larger than 40% by weight, the viscosity of the protein foam fire-extinguishing chemical is significantly increased to make uniform, stable and proportional mixing infeasible in a usual system of mixing a foam fire-extinguishing chemical, thus making practical use infeasible, while the amount of the protein hydrolyzates is smaller than 25% by weight, the protein foam fire-extinguishing chemical upon dilution at a low concentration of 2% by volume or less comes to have a lower degree of foaming with a 25% reduction time of 1 minute or less, thus failing to provide an normal aqueous foam solution usable for extinguishing fires.

According to the present invention, the protein foam fire-extinguishing chemical can, upon being mixed with water in a usual system of mixing a foam fire-extinguishing chemical, be used practically without significantly increasing the viscosity thereof, and can thus provide an aqueous foam solution diluted at a low concentration of 2% by volume or less.

The aqueous foam solution diluted even at a low concentration of 2% by volume or less can demonstrate foaming properties usable as a foam fire-extinguishing chemical and is not inferior to the conventional 3 vol-% aqueous foam solution. Further, the aqueous foam solution in the present invention solves disadvantages of the conventional 3 vol-% aqueous foam solution, such as requirements for a large-scale tank and container for storing the protein foam fire-extinguishing chemical and a large number of times the chemical is conveyed from a base for stockpiling to a site of fires, thus achieving the effects of reducing the size of the storing tank and container as well as reducing the number of times the chemical is conveyed to the site of fires.

Preferable embodiments of the present invention are listed below.

(a) A protein foam fire-extinguishing chemical, which comprises 32% by weight of protein hydrolyzates as solids compounded with 1% by weight of iron sulfate, 15% by weight of 3-methyl-3-methoxy butanol and 52% by weight of water.

(b) A protein foam fire-extinguishing chemical, which comprises 32% by weight of protein hydrolyzates as solids compounded with 1% by weight of iron sulfate, 15% by weight of 2-methyl-2,4-pentanediol and 52% by weight of water.

(c) A protein foam fire-extinguishing chemical, which comprises 32% by weight of protein hydrolyzates as solids compounded with 1% by weight of iron sulfate, 5% by weight of 2-methyl-2,4-pentanediol, 10% by weight of diethylene glycol monobutyl ether and 52% by weight of water.

(d) A protein foam fire-extinguishing chemical, which comprises 32% by weight of protein hydrolyzates as solids compounded with 1% by weight of iron sulfate, 15% by weight of diethylene glycol monoisopropyl ether and 52% by weight of water.

(e) A protein foam fire-extinguishing chemical, which comprises 36% by weight of protein hydrolyzates as solids compounded with 1% by weight of iron sulfate, 5% by weight of 2-methyl-2,4-pentanediol, 10% by weight of diethylene glycol monobutyl ether and 48% by weight of water.

(f) A protein foam fire-extinguishing chemical, which comprises 32% by weight of protein hydrolyzates as solids compounded with 1% by weight of iron sulfate, 8% by weight of 2-methyl-2,4-pentanediol (foaming assistant), 5% by weight of ethylene glycol (pour point depressant), and 54% by weight of water.

(g) A protein foam fire-extinguishing chemical, which comprises 32% by weight of protein hydrolyzates as solids compounded with 1% by weight of iron sulfate, 10% by weight of 2-methyl-2,4-pentanediol, 5% by weight of ethylene glycol and 52% by weight of water.

(h) A protein foam fire-extinguishing chemical, which comprises 32% by weight of protein hydrolyzates as solids compounded with 1% by weight of iron sulfate, 15% by weight of 2-methyl-2,4-pentanediol, 5% by weight of ethylene glycol and 47% by weight of water.

(i) A protein foam fire-extinguishing chemical, which comprises 32% by weight of protein hydrolyzates as solids compounded with 1% by weight of iron sulfate, 20% by weight of 2-methyl-2,4-pentanediol, 5% by weight of ethylene glycol and 42% by weight of water.

(j) An aqueous foam solution, wherein the concentration of the protein foam fire-extinguishing chemical described above is made 2% by volume or less by mixing it with water or seawater.

BRIEF DESCRIPTION OF THE DRAWINGS

FIG. 1 is a table showing Embodiments 1 to 5 and Comparative Example 1; and

FIG. 2 is a table showing Embodiments 6 to 9 and Comparative Examples 2 to 4.

DETAILED DESCRIPTION OF THE PREFERRED EMBODIMENT

The protein foam fire-extinguishing chemical of the present invention is in a liquid form comprising animal and plant protein hydrolyzates as a base material as well as a foam stabilizer, a foaming assistant etc. compounded therein. The foam stabilizer includes iron sulfate etc. As the foaming assistant, one or more members selected from the group consisting of 2-methyl-2,4-pentanediol, 3-methyl-3-methoxy butanol, diethylene glycol monobutyl ether and diethylene glycol monoisopropyl ether are contained. In this case, the amount (solid content) of the protein hydrolyzates compounded is 25 to 40% by weight, the amount of the foaming assistant compounded is 8 to 20% by weight, the amount of the foam stabilizer compounded is 0.5 to 2.0% by weight, and the amount of water compounded is 38 to 66.5% by weight. Further, a small amount of a fluorine type surfactant can also be added. If a small amount of a fluorine type surfactant is added, the resulting protein foam fire-extinguishing chemical, upon release onto an oil surface, shows excellent flowability of foams to reduce the time required for extinguishing fires, permits foams to be poured easily into a burning oil surface, and further excellent resistance to contamination with oil. Further, a pour point depressant such as ethylene glycol can also be added as necessary in a suitable amount.

For release to a site of fires, 2% by volume or less of the protein foam fire-extinguishing chemical described above is mixed with 98% by volume or more of water or seawater to prepare an aqueous foam solution.

Embodiment 1

32% (solid content) by weight of protein hydrolyzates were compounded with 1% by weight of iron sulfate (foam stabilizer), 15% by weight of 3-methyl-3-methoxy butanol (foaming assistant) and 52% by weight of water.

Embodiment 2

32% (solid content) by weight of protein hydrolyzates were compounded with 1% by weight of iron sulfate (foam stabilizer), 15% by weight of 2-methyl-2,4-pentanediol (foaming assistant) and 52% by weight of water.

Embodiment 3

32% (solid content) by weight of protein hydrolyzates were compounded with 1% by weight of iron sulfate (foam stabilizer), 5% by weight of 2-methyl-2,4-pentanediol (foaming assistant), 10% by weight of diethylene glycol monobutyl ether (foaming assistant) and 52% by weight of water.

Embodiment 4

32% (solid content) by weight of protein hydrolyzates were compounded with 1% by weight of iron sulfate (foam stabilizer), 15% by weight of diethylene glycol monoisopropyl ether (foaming assistant) and 52% by weight of water.

Embodiment 5

36% (solid content) by weight of protein hydrolyzates were compounded with 1% by weight of iron sulfate (foam stabilizer), 5% by weight of 2-methyl-2,4-pentanediol (foaming assistant), 10% by weight of diethylene glycol monobutyl ether (foaming assistant) and 48% by weight of water.

Embodiment 6

32% (solid content) by weight of protein hydrolyzates were compounded with 1% by weight of iron sulfate (foam stabilizer), 8% by weight of 2-methyl-2,4-pentanediol (foaming assistant), 5% by weight of ethylene glycol (pour point depressant) and 54% by weight of water.

Embodiment 7

32% (solid content) by weight of protein hydrolyzates were compounded with 1% by weight of iron sulfate (foam stabilizer), 10% by weight of 2-methyl-2,4-pentanediol (foaming assistant), 5% by weight of ethylene glycol (pour point depressant) and 52% by weight of water.

Embodiment 8

32% (solid content) by weight of protein hydrolyzates were compounded with 1% by weight of iron sulfate (foam stabilizer), 15% by weight of 2-methyl-2,4-pentanediol (foaming assistant), 5% by weight of ethylene glycol (pour point depressant) and 47% by weight of water.

Embodiment 9

32% (solid content) by weight of protein hydrolyzates were compounded with 1% by weight of iron sulfate (foam stabilizer), 20% by weight of 2-methyl-2,4-pentanediol (foaming assistant), 5% by weight of ethylene glycol (pour point depressant) and 42% by weight of water.

Comparative Example 1

32% (solid content) by weight of protein hydrolyzates were compounded with 1% by weight of iron sulfate (foam stabilizer), 3% by weight of 2-methyl-2,4-pentanediol (foaming assistant), 5% by weight of ethylene glycol (pour point depressant) and 59% by weight of water.

Comparative Example 2

32% (solid content) by weight of protein hydrolyzates were compounded with 1% by weight of iron sulfate (foam stabilizer), 5% by weight of ethylene glycol (pour point depressant) and 62% by weight of water. No foaming assistant was blended.

Comparative Example 3

32% (solid content) by weight of protein hydrolyzates were compounded with 1% by weight of iron sulfate (foam stabilizer), 5% by weight of 2-methyl-2,4-pentanediol (foaming assistant), 5% by weight of ethylene glycol (pour point depressant) and 57% by weight of water.

Comparative Example 4

32% (solid content) by weight of protein hydrolyzates were compounded with 1% by weight of iron sulfate (foam stabilizer), 25% by weight of 2-methyl-2,4-pentanediol (foaming assistant), 5% by weight of ethylene glycol (pour point depressant) and 37% by weight of water.

The protein foam fire-extinguishing chemicals in Embodiments 1 to 9 and Comparative Examples 1 to 4 above were examined in a viscosity test (product viscosity), a foaming degree test on an aqueous foam solution diluted at a concentration of 2% by volume, a 25% reduction time test, a fire-extinguishing performance test, a sealing test and a fire-resistant test in the following manner.

(1) Viscosity Test

Viscosity was measured at a temperature of 20° C. by a method of testing the kinematic viscosity and viscosity of a petroleum product stipulated under JIS K 2283, according to a ministerial ordinance stipulating technical standards for foam fire-extinguishing chemicals.

(2) Foaming Degree Test

Water was added a protein foam fire-extinguishing chemical to produce an aqueous foam solution at a concentration of 2% by volume, and according to the same ministerial ordinance, the aqueous foam solution at a temperature of 20° C. was foamed through a standard foaming nozzle at a water pressure of 0.69 MPa at a rate of release of 10 L water/min to examine the degree of foaming (that is, the ratio by volume of the aqueous foam solution to foams generated).

(3) 25% Reduction Time Test

According to the same ministerial ordinance, the time required for an aqueous foam solution in a volume of 25% of the aqueous foam solution before foaming to be reduced from the foams was measured.

(4) Fire-extinguishing Performance Test

According to the same ministerial ordinance, a fire model B (for low-foaming chemicals) containing 320 L water and 200 L gasoline was ignited, and in 1 minute after ignition, the aqueous foam solution at a temperature of 20° C. was continuously foamed thereon for 5 minutes to confirm the fire-extinguishing performance thereof.

(5) Sealing Test

In the fire-extinguishing performance test described above, it was confirmed whether or not re-ignition occurred by bringing flame on an ignition device close to the surface of foams in 15 minutes after foaming.

(6) Fire Resistant Test

Following the fire-extinguishing performance test described above, foaming was finished, and the oil surface under a central surface of foams was exposed in the form of a square having one side of 15 cm, then ignited and burned for 5 minutes, and it was confirmed whether the burning area of the oil surface was 900 $Cm^2$ or less.

The results of each test are as follows:

(1) Results of the Viscosity Test

In the results of the viscosity test as shown in the tables in FIGS. 1 and 2, the viscosity was as low as 23 to 28 cSt in Comparative Example 2 where no foaming assistant was compounded or in Comparative Examples 1 and 3 where the foaming assistant was compounded in a small amount (3 to 5% by weight), while the viscosity was as relatively high as 120 cSt in Comparative Example 4 where the foaming assistant was compounded in a large amount of 25% by weight. In Embodiments 1 to 9 where the foaming assistant was compounded in an amount of 8 to 20% by weight, a suitable viscosity of 36 to 55 cSt could be obtained.

When an aqueous foam solution containing each of the protein foam fire-extinguishing chemicals in Comparative Examples 1 to 3 at a concentration of 2% by volume was actually used, the degree of foaming was low, the 25% reduction time was 1 minute or less, and fires could not be extinguished, as is revealed by the results in the foaming degree test and the 25% reduction time test described below. On the other hand, when each of the protein foam fire-extinguishing chemicals in Embodiments 1 to 9 was used, the degree of foaming was 8 times or more, the 25% reduction time was 3 minutes or more, and they were found to be excellent in fire-extinguishing performance, sealing properties and fire resistance, as is revealed by the test results described below.

Those protein foam fire-extinguishing chemicals having suitable viscosity, such as in Comparative Examples 1 to 3 and Embodiments 1 to 9, could be proportionally mixed uniformly and stably at a predetermined concentration in an existing ordinary system of mixing a foam fire-extinguishing chemical, such as the pressure proportional system, pump proportional system, line proportional system etc., but those protein foam fire-extinguishing chemicals having a high viscosity of 120 cSt, such as in Comparative Example 4, could not be proportionally mixed at a predetermined concentration in any foam fire-extinguishing mixing system described above, and could not be practically used.

(2) Results of the Foaming Degree Test

In the results of the foaming degree test as shown in the tables in FIGS. 1 and 2, the degree of foaming was as low as 3.8 to 4.7 times as shown in Comparative Example 2 where no foaming assistant was compounded or in Comparative Examples 1 and 3 where the foaming assistant was compounded in a small amount of 3 to 5% by weight, while good results of 8 times or more could be obtained in Embodiments 1 to 9 where the foaming assistant was compounded in an amount of 8 to 20% by weight.

(3) Results of the 25% Reduction Time Test

In the results of the 25% reduction time test as shown in the tables in FIGS. 1 and 2, the reduction time was 1 minute or less as shown in Comparative Example 2 where no foaming assistant was compounded or in Comparative Examples 1 and 3 where the foaming assistant was compounded in a small amount of 3 to 5% by weight, while good results of 3 minutes or more could be obtained in Embodiments 1 to 9 where the foaming assistant was compounded in an amount of 8 to 20% by weight.

(4) Results of the fire-extinguishing performance test

In the results of the fire-extinguishing performance test as shown in the tables in FIGS. 1 and 2, fires could not be extinguished as shown in Comparative Example 2 where no foaming assistant was compounded or in Comparative Examples 1 and 3 where the foaming assistant was compounded in a small amount of 3 to 5% by weight, while fire extinction was good in Embodiments 1 to 9 where the foaming assistant was compounded in an amount of 8 to 20% by weight.

(5) Results of The Sealing Test

In the results of the sealing test as shown in the tables in FIGS. 1 and 2, the sealing test was not conducted for Comparative Examples 1 to 3 because fire extinction was not feasible in the previous fire-extinguishing performance test, while in Embodiments 1 to 9, re-ignition did not occur and the sealing properties were excellent.

(6) Results of the Fire Resistant Test

In the results of the fire resistant test as shown in the tables in FIGS. 1 and 2, the fire resistant test was not conducted for Comparative Examples 1 to 3 because fire extinction was not feasible in the previous fire-extinguishing performance test, while in Embodiments 1 to 9, the burning area of the oil surface was 900 $cm^2$ or less to indicate excellent fire resistance.

The entire disclosure of Japanese Patent Application No. 2000-311954 filed on Oct. 12, 2000 including the specification, claims, drawings and summary are incorporated herein by reference in its entirety.

What is claimed is:

1. A protein foam fire-extinguishing chemical in a liquid form comprising:

protein hydrolyzates as a base material, wherein the protein hydrolyzates are contained in an amount of 25 to 40% by weight in terms of the solid content of the liquid form of the protein fire-extinguishing chemical;

a foam stabilizer compounded in the base material, wherein the amount of foam stabilizer compounded is 0.5 to 2.0% by weighted a foaming assistant compounded in the base material, wherein the amount of the foaming assistant compounded is 8 to 20% by weight and the foaming assistant comprises one or more members selected from the group consisting of 2-methyl-2,4-pentanediol, 3-methyl-3-methoxy butanol, diethylene glycol monobutyl ether and diethylene glycol monoisopropyl ether; and an amount of water compounded is 38 to 66.5% by weight.

2. The protein foam fire-extinguishing chemical according to claim 1, wherein the amount of the foaming assistant compounded is 10 to 15% by weight.

3. The protein foam fire-extinguishing chemical according to claim 1, wherein the protein hydrolyzates are contained in an amount of 30 to 35% by weight in terms of the solid content thereof.

4. The protein foam fire-extinguishing chemical according to claim 1, which further comprises a fluorine surfactant.

5. The protein foam fire-extinguishing chemical according to claim 1, which comprises 32% by weight of protein hydrolyzates as solids compounded with 1% by weight of iron sulfate, 15% by weight of 3-methyl-3-methoxy butanol and 52% by weight of water.

6. The protein foam fire-extinguishing chemical according to claim 1, which comprises 32% by weight of protein hydrolyzates as solids compounded with 1% by weight of iron sulfate, 15% by weight of 2-methyl-2,4-pentanediol and 52% by weight of water.

7. The protein foam fire-extinguishing chemical according to claim 1, which comprises 32% by weight of protein hydrolyzates as solids compounded with 1% by weight of iron sulfate, 5% by weight of 2-methyl-2,4-pentanediol, 10% by weight of diethylene glycol monobutyl ether and 52% by weight of water.

8. The protein foam fire-extinguishing chemical according to claim 1, which comprises 32% by weight of protein hydrolyzates as solids compounded with 1% by weight of iron sulfate, 15% by weight of diethylene glycol monoisopropyl ether and 52% by weight of water.

9. The protein foam fire-extinguishing chemical according to claim 1, which comprises 36% by weight of protein hydrolyzates as solids compounded with 1% by weight of iron sulfate, 5% by weight of 2-methyl-2,4-pentanediol, 10% by weight of diethylene glycol monobutyl ether and 48% by weight of water.

10. The protein foam fire-extinguishing chemical according to claim 1, which comprises 32% by weight of protein hydrolyzates as solids compounded with 1% by weight of iron sulfate, 8% by weight of 2-methyl-2,4-pentanediol as a foaming assistant, 5% by weight of ethylene glycol as a pour point depressant, and 54% by weight of water.

11. The protein foam fire-extinguishing chemical according to claim 1, which comprises 32% by weight of protein hydrolyzates as solids compounded with 1% by weight of iron sulfate, 10% by weight of 2-methyl-2,4-pentanediol, 5% by weight of ethylene glycol and 52% by weight of water.

12. The protein foam fire-extinguishing chemical according to claim 1, which comprises 32% by weight of protein hydrolyzates as solids compounded with 1% by weight of iron sulfate, 15% by weight of 2-methyl-2,4-pentanediol, 5% by weight of ethylene glycol and 47% by weight of water.

13. The protein foam fire-extinguishing chemical according to claim 1, which comprises 32% by weight of protein hydrolyzates as solids compounded with 1% by weight of iron sulfate, 20% by weight of 2-methyl-2,4-pentanediol, 5% by weight of ethylene glycol and 42% by weight of water.

14. An aqueous foam solution, wherein the concentration of the protein foam fire-extinguishing chemical described in claim 1 is made 2% by volume or less by mixing it with water or seawater.

* * * * *